United States Patent [19]

Lin

[11] 4,232,477

[45] Nov. 11, 1980

[54] INFLATABLE HASSOCK-SHAPED TOY

[75] Inventor: Charles C. C. Lin, Taipei, Taiwan

[73] Assignee: Shelcore, Inc., New York, N.Y.

[21] Appl. No.: 37,652

[22] Filed: May 11, 1979

[51] Int. Cl.[3] ..... A63H 3/06; A47C 9/00; A47C 25/00

[52] U.S. Cl. ..... 46/88; 297/462; 297/DIG. 3; 46/87

[58] Field of Search ..... 46/87–90; 40/453, 575; 297/462, 456, DIG. 3, DIG. 8; 312/204

[56] References Cited

U.S. PATENT DOCUMENTS

| | | | |
|---|---|---|---|
| 2,614,272 | 10/1952 | Morner | 297/DIG. 3 |
| 2,804,123 | 8/1957 | Kling | 46/87 |
| 2,987,735 | 6/1961 | Nail | 297/456 |
| 3,017,642 | 1/1962 | Rosenberg et al. | 297/DIG. 3 |
| 3,023,050 | 2/1962 | Jensen | 297/462 |
| 3,029,109 | 4/1962 | Nail | 297/462 |
| 3,110,532 | 11/1963 | Nail | 297/462 |
| 3,125,377 | 3/1964 | Bridges | 297/DIG. 8 |
| 3,181,913 | 5/1965 | Guido et al. | 40/575 |
| 4,034,495 | 7/1977 | Lemelson | 40/453 |
| 4,133,064 | 1/1979 | Petrusek | 46/87 |

*Primary Examiner*—Louis G. Mancene
*Assistant Examiner*—Michael J. Foycik, Jr.
*Attorney, Agent, or Firm*—Kirschstein, Kirschstein, Ottinger & Cobrin

[57] ABSTRACT

An inflatable toy which when inflated has the contour of a hassock. The toy features a cylindrical envelope and inner radially-extending planar baffles, these elements being composed of soft limp flexible material such as a thermoplastic plastic. When the toy is inflated by introducing air under mild pressure into the envelope, the top and bottom walls of the envelope are distended so as to assume the contour of the top and bottom of a hassock, i.e. with a central bulge and discrete radial outward bulges. This configuration is formed by disposing the baffles vertically and mutually angularly spaced, each of the baffles extending radially from near the central axis of the envelope and terminating short of the periphery of the envelope, with rectilinear attachments of the top and bottom edges of each of the baffles to the top and bottom walls of the envelope. The baffles are tautened by outward force exerted on the top and bottom walls between the baffles, by the pressure of the inflating air. The baffles are spaced from and free of attachment to the cylindrical side wall of the envelope, so that the side wall assumes a horizontally outwardly bulging barrel-shaped contour when the envelope is inflated. The inner edges of adjacent baffles are spaced apart when the envelope is inflated. At least one discrete solid object is disposed inside the envelope, the object being sized to pass between the inner edges of adjacent baffles to the central axis of the envelope.

13 Claims, 5 Drawing Figures

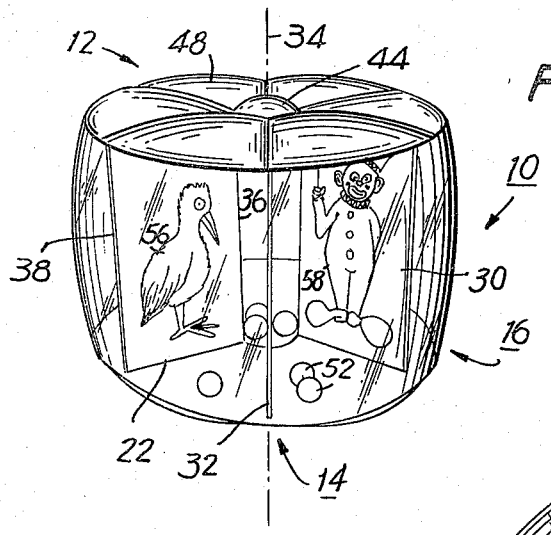
FIG. 1
FIG. 2
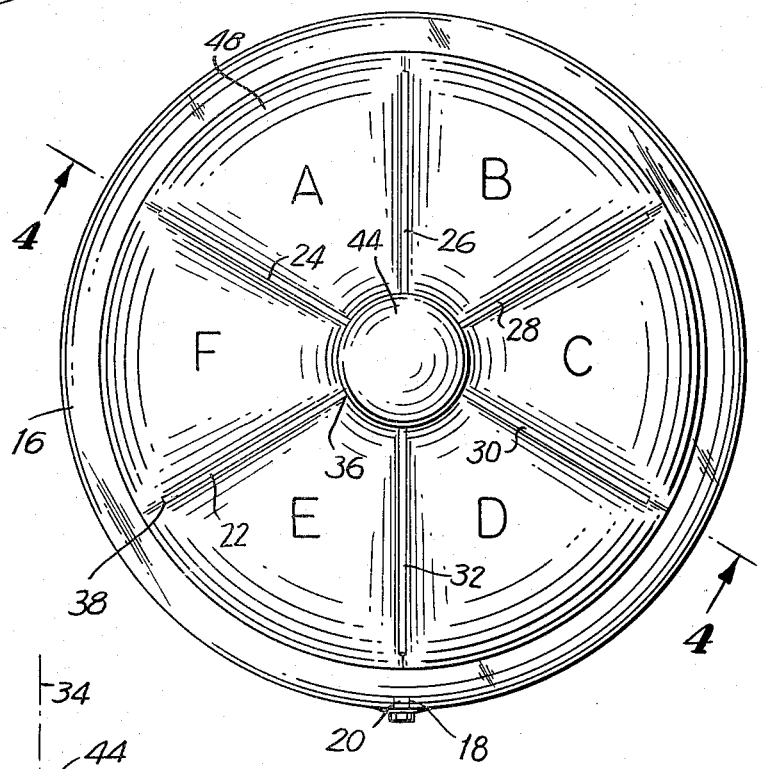
FIG. 3
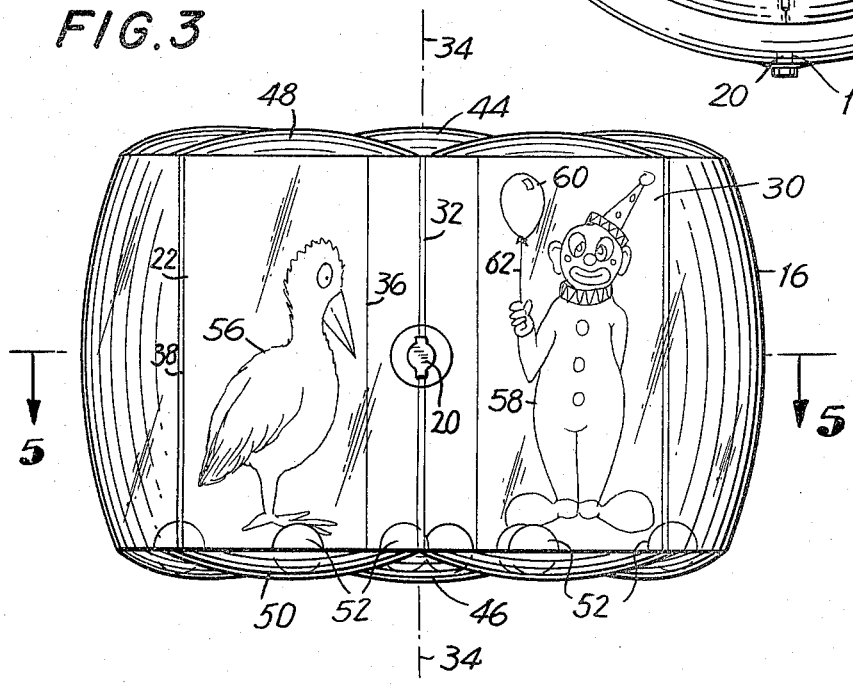

INFLATABLE HASSOCK-SHAPED TOY

BACKGROUND OF THE INVENTION

1. Field of the Invention

An inflatable plastic toy which when inflated resembles a hassock.

2. Description of the Prior Art

Inflatable plastic toys have been used and enjoyed by children for many years. When inflated they are light in weight and flexible and are readily moved about, manipulated, distorted or bent, or squeezed and partially deformed by the child. Thus inflatable plastic toys provide fun and enjoyment for even the smallest child, whether in the nursery or playroom or elsewhere in the home, at the beach, on the lawn of a private dwelling or in a park or play ground, or elsewhere. These toys may be made and assembled so that when inflated they resemble fanciful characters, animals or objects in the home or elsewhere with which the child is familiar. Among the many patents relating to inflatable toys and actual hassocks of the inflatable type may be mentioned U.S. Pat. Nos. 3,029,109; 3,110,532; 3,125,377; 3,181,913 and 4,034,495 and U.S. Design Pat. No. 162,022.

SUMMARY OF THE INVENTION

1. Purposes of the Invention

It is an object of the present invention to provide an improved inflatable toy.

Another object is to provide an inflatable toy which when inflated resembles a hassock.

A further object is to provide an inflatable plastic toy for the enjoyment of children.

An additional object is to provide an inflatable toy which when inflated is light in weight and readily manipulated by a child.

Still another object is to provide an inflatable plastic toy which may readily be assembled and mass-produced at low cost using inexpensive materials of construction and unskilled labor.

Still a further object is to provide an inflatable contoured plastic toy which is rugged and serviceable and not readily broken by the child.

These and other objects and advantages of the present invention will become evident from the description which follows.

2. Brief Description of the Invention

The toy of the present invention may briefly be described as an inflatable hassock-shaped toy which has a transparent cylindrical plastic wall and a pair of opaque plastic upper and lower walls. Each end wall has a plurality, typically six, outwardly-bulging segment-shaped portions and a central outwardly-bulging circular-shaped portion. The overall outward appearance of the toy resembles a hassock. Six radially-extending plastic partitions are equi-angularly spaced within the interior of the toy. A plurality of balls are also located within the interior of the toy. Each partition is taut to thereby form the crease lines which separate the segment-shaped portions on the end walls. The balls can bounce around and travel freely from one zone bounded by a pair of adjacent partitions to another zone bounded by any other pair of adjacent partitions. The balls enter any particular zone through the space defined by the inner edges of the respective pair of partitions. Each partition has cartoon-type artwork printed thereon which is visible through the transparent side wall.

Thus the present toy basically has the following features. It has an opaque top wall, an opaque bottom wall, and a transparent side wall, all of heavy gauge synthetic plastic material, and all being conveniently heat sealed to form an air-receivable interior chamber which is adapted to be inflated through a valve. Six radially-extending synthetic plastic material partitions are equi-angularly spaced in the chamber about a vertical axis. Each partition has an upper edge heat sealed to the top wall along a radially-extending seam, and a lower edge heat sealed to the bottom wall along a radially-extending seam. Each partition not only subdivides the chamber, but also controls the contour of the bottom and top walls upon inflation by restricting relative separation of the bottom and top walls along the seam lines. Each partition has a fully-extended length which effectively prevents the toy from bulging outwardly in all directions into a perfect spherical shape and, in fact, the partitions serve to somewhat flatten the bottom and top walls. The top and bottom walls both have a centrally circular portion, and each partition has an inner edge which is located at the circumference of this central circular portion. Upon inflatin, the toy resembles a hassock, because the central circular portion bulges outwardly to thereby resemble a hassock button, and because the seams define outwardly-bulging segment-or sector-shaped portions to thereby resemble a quilted hassock having triangular raised portions. A plurality of balls are located within the chamber. The inner edges of each two successive partitions are spaced sufficiently far enough apart to permit at least one ball to enter the compartment bounded by the two respective partitions. Each partition has outer edges which are located away from the side wall at a spacing which is either smaller than the diameter of a ball, to thereby prevent the latter from entering into another compartment through this spacing, or greater than the diameter of a ball, to thereby permit the balls to pass freely from one compartment to an adjacent compartment between the outer edge of a partition and the side wall. Cartoon-type art work which is visible through the transparent side wall is provided on the partitions.

In summary, the present invention entails the provision of an inflatable toy which when inflated resembles and has the contour of a hassock. The toy includes an envelope which when inflated is generally cylindrical with generally circular and flat top and bottom walls and a generally cylindrical side wall. The envelope is composed of soft limp flexible non-resilient sheet material, and has an opening in one of the walls to enable the envelope to have air under mild pressure introduced into its interior so that the envelope can be inflated. Means is provided to selectively close the opening in the wall of the envelope, in order to selectively retain air in the envelope and thereby keep the envelope inflated.

A plurality of soft limp flexible planar vertical baffles are mutually angularly spaced within the envelope. Each of the baffles extends radially from near the central axis of the envelope and terminates short of the periphery of the envelope. The top and bottom edges of each of the baffles are attached to the circular top and bottom walls of the envelope by rectilinear means such as fusion, gluing, stabling, sewing or the like. Thus, the top and bottom walls of the envelope have a contour with a central outward bulge and discrete radial outward bulges between adjacent rectilinear attachment means, when the envelope is inflated. Concomitantly with inflation of the envelope, the baffles are tautened by outward force exerted on the top and bottom walls between the baffles by the pressure of the inflating air. The baffles are spaced from and free of attachment to the generally cylindrical side wall of the envelope, so that the side wall of the envelope, when the envelope is inflated, has a horizontally outwardly-bulging barrel-shaped contour.

The inner edges of adjacent baffles are spaced apart when the envelope is inflated. At least one discrete solid object is provided within the envelope, and the object is sized to pass between the inner edges of adjacent baffles to the central axis of the envelope. The object is also preferably sized to pass alternately, but not necessarily, between the outer edge of a baffle and the side wall of the inflated envelope. Usually a plurality of discrete solid objects such as spheres or hollow plastic balls are provided within the envelope.

In a preferred embodiment, at least a portion of the side wall of the envelope is transparent, and an illustration is provided on at least one face of at least one baffle. Typically the illustration is that of a cartoon character, an animal or a clown, to provide amusement and interest for the child. In addition, in most cases at least one illustration is provided on at least one wall of the envelope. Typically, this illustration appears on the preferably opaque top wall of the envelope.

The envelope and the baffles are typically composed of a thermoplastic plastic such as polyethylene, polypropylene especially isotactic polypropylene, polystyrene, an acrylic resin such as polymethyl methacrylate, polyvinyl chloride, polyacrylonitrile, polyvinyl acetate, polytetrafluoroethylene, polyoxymethylene, a cellulosic, or nylon.

The inflatable toy of the present invention provides several salient advantages. The toy is light in weight and pleasing in appearance, and thus the toy may readily be manipulated by a child who thus derives a great deal of the pleasure and enjoyment in playing with the toy. The present toy is readily fabricated and assembled from simple shapes of low cost plastic sheet material, and thus the present toy may readily be mass-produced at low cost using unskilled labor. The toy when manipulated is an action toy, with the internal discrete solid objects providing internal motion when the toy is moved or manipulated, i.e., the objects such as balls move about and spill from compartment to compartment within the envelope, alternately centrally and then laterally outwards and inwards. The toy thus provides a great deal of pleasure for a child, is of low cost, and is not readily broken by the child, being resilient, rugged and serviceable.

The invention accordingly consists in the features of construction, combination of elements and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is a perspective view of the present toy in the inflated condition;

FIG. 2 is a plan view of the toy of FIG. 1;

FIG. 3 is an elevation view of the toy in FIG. 1;

DETAILED DESCRIPTION OF THE PREFERRED EMBODIMENT

Figure 5:
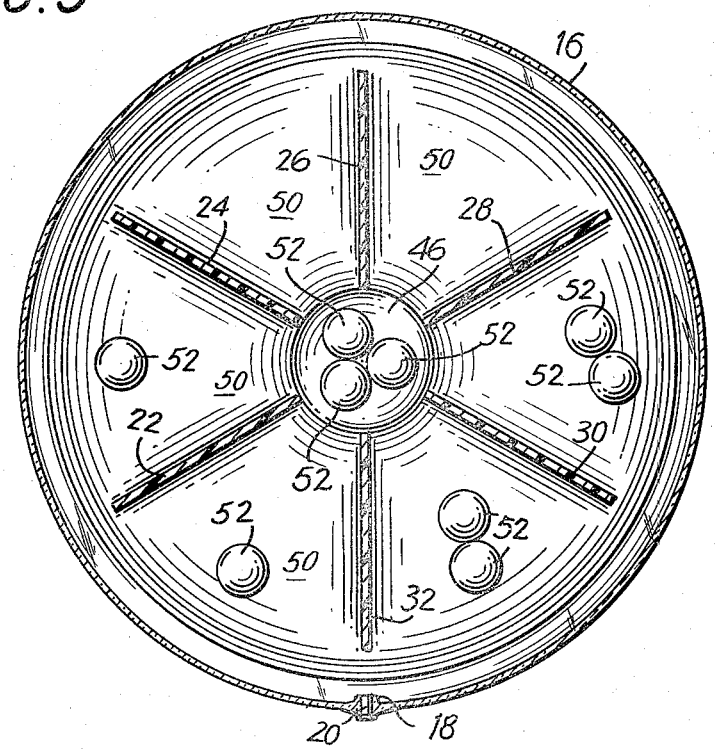
FIG. 5 is a sectional plan view taken substantially along the line 5—5 of FIG. 3.

Referring now to the FIGURES, the inflated and hassock-shaped toy 10 has an outer substantially cylindrical envelope consisting of the substantially circular and flat top wall 12, the substantially circular and flat bottom wall 14, and the substantially cylindrical side wall 16. As best seen in FIGS. 2, 3 and 5, the envelope has an opening 18 in the side wall 16 which is closed by the detachable plastic plug 20. This plug 20 constitutes a means to selectively close the opening 18 in order to selectively retain air in the envelope and thereby keep the envelope inflated. It will be appreciated by those skilled in the art that the envelope as shown has typically been manually inflated by removing the plug 20 from the limp and collapsed toy and blowing breath from a human mouth through the opening 18. Air may of course be admitted into the envelope by a variety of other means such as the use of piston-type air pump as commonly employed to inflate pneumatic automobile tires.

Six vertical baffles 22, 24, 26, 28, 30 and 32 are shown within the envelope. These soft limp flexible baffles are shown in a planar vertical configuration due to inflation of the envelope, and as shown, the baffles are mutually angularly spaced within the envelope. Each of the baffles extends radially from near the central axis 34 of the envelope and terminates short of the periphery of the envelope. Referring specifically to the baffle 22, inner vertical edge 36 is spaced from the central axis 34, and outer vertical edge 38 terminates short of the periphery of the side wall 16.

Figure 4:
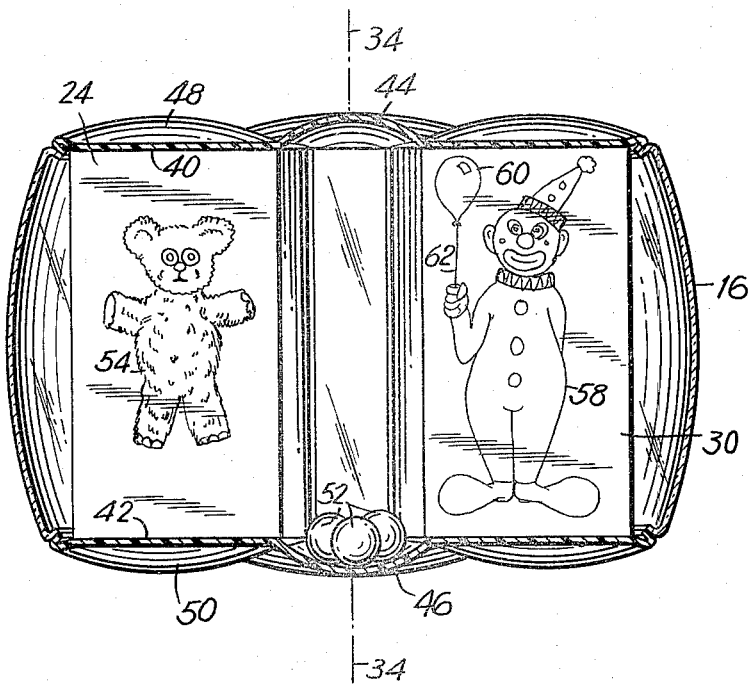
FIG. 4 is a sectional elevation view taken substantially along the line 4—4 of FIG. 2.

Referring to the baffle 24 (FIG. 4), the rectilinear attachment means at 40 and 42 attach the respective top and bottom edges of the baffle 24 to the respective top and bottom walls 12 and 14 of the envelope. Thus, as shown, the top and bottom walls of the inflated envelope have a contour with a respective central outward bulge 44 and 46, and discrete radial outward bulges such as 48 (wall 12) and 50 (wall 14) between adjacent rectilinear attachment means, i.e. between the baffles 24 and 26. Due to the pressure of the inflating air, the baffles are tautened into a planar configuration by outward force exerted on the top wall 12 and the bottom wall 14. As mentioned supra, and as best seen in FIG. 4, the baffles are spaced from and free of attachment to the substantially cylindrical side wall 16, so that the side wall 16 of the inflated envelope has a horizontally outwardly bulging barrel-shaped contour.

A plurality of discrete spherical hollow plastic balls 52 are disposed within the envelope, and the inner edges of the baffles, such as edge 36, are sufficiently spaced apart in the inflated envelope, so that the balls 52 can pass between these inner baffle edges to the central axis 34 of the envelope.

As shown in FIG. 2, illustrations consisting of the letter A, B, C, D, E and F are provided on the top wall 12 of the envelope. A representation consisting of an illustration 54 of a lovable teddy bear is provided on the face of the baffle 24 (FIG. 4), while FIGS. 1 and 3 show an illustration 56 of a bird on the face of the baffle 22. Finally, an illustration 58 of a happy clown holding a balloon 60 on a string 62 appears on the face of the baffle 30.

It thus will be seen that there is provided an article of manufacture consisting of an inflatable hassock-shaped toy which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understtod by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. An inflatable toy, which when inflated has the contour of a hassock, which comprises an envelope, said envelope when inflated being substantially cylindrical with substantially circular and flat top and bottom walls and a substantially cylindrical side wall, said envelope being composed of soft limp flexibe non-resilient sheet material, said envelope having an opening in a wall thereof to enable the envelope to have air under mild pressure introduced into the interior thereof so as to inflate the same, means to selectively close said opening in the wall of the envelope in order to selectively retain air in the envelope and thereby keep the envelope inflated, a plurality of soft limp flexible planar vertical baffles mutually angularly spaced within said envelope, each of said baffles extending radially from near the central axis of said envelope and terminating short of the periphery of said envelope, rectilinear means attaching the top and bottom edges of each of said baffles to the circular top and bottom walls of said envelope, so that the top and bottom walls of said envelope, when said envelope is inflated, have a contour with a central outward bulge and discrete radial outward bulges between adjacent rectilinear attachment means, said baffles being tautened by outward force exerted on the top and bottom walls between the baffles by the pressure of the inflating air, said baffles being spaced from and free of attachment to the substantially cylindrical side wall of said envelope, so that the side wall of said envelope, when said envelope is inflated, has a horizontally outwardly bulging barrel-shaped contour, and at least one discrete solid object within said envelope, the inner edges of adjacent baffles being spaced apart when the envelope is inflated, said object being sized to pass between the inner edges of adjacent baffles to the central axis of said envelope.

2. The inflatable toy of claim 1 in which the object is sized to pass alternately between the outer edge of a baffle and the side wall of the inflated envelope.

3. The inflatable toy of claim 1 in which a plurality of discrete solid objects are provided within the envelope.

4. The inflatable toy of claim 1 in which the solid object is spherical.

5. The inflatable toy of claim 1 in which at least a portion of the side wall is transparent, and an illustration is provided on at least one face of at least one baffle.

6. The inflatable toy of claim 5 in which the illustration is that of an animal.

7. The inflatable toy of claim 5 in which the illustration is that of a clown.

8. The inflatable toy of claim 1 in which at least one illustration is provided on at least one wall of the envelope.

9. The inflatable toy of claim 8 in which the illustration appears on the top wall of the envelope.

10. The inflatable toy of claim 1 in which the envelope and the baffles are composed of a thermoplastic plastic selected from the group consisting of polyethylene, polypropylene, polystyrene, and acrylic resin, polyvinyl chloride, polyacrylonitrile, polyvinyl acetate, polytetrafluoroethylene, polyoxymethylene, a cellulosic and nylon.

11. The inflatable toy of claim 10 in which the envelope and the baffles are composed of isotactic polypropylene.

12. The inflatable toy of claim 10 in which the envelope and the baffles are composed of polymethyl methacrylate.

13. An inflatable contoured article comprising:

(A) flexible wall means including a pair of end walls and an annular side wall connected intermediate the latter and having an inner circumferential surface, all of said walls bounding an interior compartment;

(B) means for inflating said flexible wall means from an initial collapsed configuration to an inflated configuration in which said annular side wall surrounds an axis of symmetry and in which the centers of said end walls are located at opposite axial ends of the symmetry axis;

(C) means for controlling the contour of said wall means by restricting relative separation of said end walls upon inflation, including 1. a plurality of flexible, taut, generally planar, baffle-type partitions located within said compartment and being equi-angularly spaced about the symmetry axis to thereby sub-divide said compartment into a corresponding plurality of sector-shaped chambers, each partition having
   (a) an axially-extending inner edge spaced radially from the symmetry axis at a predetermined radial distance,
   (b) an axially-extending outer edge spaced radially from the symmetry axis at a radial distance greater than said predetermined distance,
   (c) a radially-extending upper edge connected to one of said end walls, and
   (d) a radially-extending lower edge connected to the other of said end walls,
2. all of said inner edges of the partitions terminating at the end walls at inner annuli which have a radius equal to said predetermined radial distance and which surround the symmetry axis, and thereby forming upon inflation each end wall with a central, generally circular outwardly-bulging portion which is free from constraint by said partitions,
3. all of said outer edges of the partitions terminating at the end walls at outer annuli which have a radius equal to said greater radial distance and which are concentric with the inner annuli,
4. all of said radially-extending upper and lower edges of the partitions terminating at the end walls along seams which extend radially relative to the symmetry axis and thereby forming upon inflation each end wall with outwardly-bulging generally sector-shaped portions which are free from constraint by said partitions, 5. said outwardly-bulging central circular portion and said sector-shaped portions on each end wall together resembling a hassock seat upon inflation, 6. each two inner edges of each two adjacent partitions being spaced circumferentially apart of each other by a predetermined spacing, and 7. each outer edge of the partitions being spaced radially from said inner circumferential surface of said side wall by a preselected spacing; and (D) means for impacting against said wall means in the inflated configuration to thereby provide entertainment reward for a child, including (1.) a plurality of movable amusement-type toy objects within said interior compartment, each toy object having a cross-sectional dimension which is smaller than said predetermined spacing to thereby permit passage through the latter of at least one toy object into any one of said chambers, and which is larger than said preselected spacing to thereby bar passage through the latter of the toy objects from one chamber to another.

* * * * *